US006065162A

United States Patent [19]

Behr

[11] Patent Number: 6,065,162

[45] Date of Patent: May 23, 2000

[54] PATIENT POSITIONING DEVICE

[76] Inventor: Lawrence V. Behr, 3400 Tupper La., Greenville, N.C. 27834

[21] Appl. No.: 09/121,069

[22] Filed: Jul. 21, 1998

Related U.S. Application Data

[60] Provisional application No. 60/058,057, Sep. 5, 1997.

[51] Int. Cl.[7] ..... A61G 7/10

[52] U.S. Cl. ..... 5/81.1 R; 5/81.1 HS; 5/86.1; 5/88.1; 248/173

[58] Field of Search ..... 5/81.1 R, 81.1 HS, 5/488, 83.1, 86.1, 88.1; 248/166, 173

[56] References Cited

U.S. PATENT DOCUMENTS

| | | | |
|---|---|---|---|
| 2,666,212 | 1/1954 | Flanders | 5/86.1 |
| 2,666,930 | 1/1954 | Lenahan | 5/86.1 |
| 2,903,238 | 9/1959 | Flandrick | 5/83.1 X |
| 3,042,936 | 7/1962 | Patterson | 5/83.1 |
| 3,794,313 | 2/1974 | Berger et al. | 5/488 X |
| 3,810,263 | 5/1974 | Taylor et al. | 5/81.1 C |
| 3,924,281 | 12/1975 | Gibbs . | |
| 4,087,873 | 5/1978 | Ohkawa . | |
| 4,502,169 | 3/1985 | Persson . | |
| 4,545,085 | 10/1985 | Feldt | 5/86.1 X |
| 4,631,761 | 12/1986 | Lederman . | |
| 4,747,170 | 5/1988 | Knouse . | |
| 4,776,047 | 10/1988 | DiMatteo . | |
| 4,843,665 | 7/1989 | Cockel et al. . | |
| 4,868,938 | 9/1989 | Knouse . | |
| 5,022,106 | 6/1991 | Richards | 5/86.1 |
| 5,054,140 | 10/1991 | Bingham et al. . | |
| 5,155,874 | 10/1992 | Kershaw . | |
| 5,185,894 | 2/1993 | Bastert et al. . | |
| 5,274,862 | 1/1994 | Palmer, Jr. et al. . | |
| 5,308,029 | 5/1994 | Bingham . | |
| 5,315,723 | 5/1994 | Smith | 5/88.1 X |
| 5,369,821 | 12/1994 | Richards et al. | 5/86.1 |
| 5,390,379 | 2/1995 | Palmer, Jr. et al. . | |
| 5,412,820 | 5/1995 | Richards | 5/86.1 |
| 5,524,304 | 6/1996 | Shutes . | |
| 5,530,974 | 7/1996 | Rains et al. . | |
| 5,540,321 | 7/1996 | Foster . | |
| 5,697,109 | 12/1997 | Hodgetts | 5/81.1 HS |
| 5,819,339 | 10/1998 | Hodgetts | 5/88.1 |
| 5,937,456 | 8/1999 | Norris | 5/88.1 |

*Primary Examiner*—Brian K. Green
*Assistant Examiner*—Robert G. Santos
*Attorney, Agent, or Firm*—Rhodes & Mason, PLLC

[57] ABSTRACT

A device for turning or moving a bedridden patient on a bed having opposed sides by pulling a sheet positioned under the patient toward one said of the bed, the device including a support frame with first and second vertical roller support arms, and a horizontal base connecting the support arms; a horizontal roller including sheet attachment clips supported by the support arms; an electric motor mounted on the frame and operatively attached to the roller through the interior of the frame; wheeled legs pivotally attached at their inner ends to the frame; and electrical circuitry controlling the operation of the motor, the circuitry including a timer for stopping operation of the motor after a predetermined time period, and wiring within the frame interior.

11 Claims, 3 Drawing Sheets

PATIENT POSITIONING DEVICE

This Application claims benefit of Provisional Application No. 60/058,057 Sep. 5, 1997.

BACKGROUND OF THE INVENTION (1) Field of the Invention

The present invention relates generally to an apparatus for use by caregivers in positioning bedridden persons, and in particular to an apparatus for use in positioning individuals who are confined to a bed, and unable to easily move without the assistance of others. The apparatus is useful in turning patients in a bed as well as in moving patients from one bed to another.

(2) Description of the Prior Art

Numerous devices are described in the prior art that purport to be positioning a person that is confined to a bed. The following patents are representative of these prior art devices:

| U.S. Pat. No. | Inventor(s) |
|---|---|
| 4,502,169 | Persson |
| 5,054,140 | Bingham et al. |
| 5,155,874 | Kershaw |
| 5,524,304 | Shutes |
| 5,530,974 | Rains et al. |

However, despite the disclosure of numerous prior art devices, no apparatus is currently available that meets all of the requirements for this type of device. A patient positioning device must be useable by a single caregiver, enabling the caregiver to turn or move the bedridden patient to the desire position with minimal exertion by the caregiver, and insignificant trauma to the patient. In addition, the patient positioning device must be readily moveable, self-contained without exposure of operating components to the patient or caregiver, quickly repairable, and easy to clean. A device meeting these requirements would be of considerable value.

SUMMARY OF THE INVENTION

The present invention is directed to a device used by a caregiver to position a bedridden patient. The invention relates especially to a self-contained, moveable apparatus that can be readily positioned next to a bed by a single caregiver, and used to pull a sheet toward one side of the bed, and thereby turn a patient on the sheet with minimal effort. The apparatus can also be used to move a patient from one bed to another by placing the sheet across both bed surfaces.

As used herein, the term "sheet" is used generally to designate a flexible horizontal structure, which will ordinarily be made of a woven textile fabric. One end of the sheet is connected to the roller during use. For example, a folded sheet of the type used as a bed covering, i.e., a top sheet can be used. Alternatively, a specially made textile sheet having a width of about 3 feet and a length of up to about 10 feet can be used.

The patient positioning device is comprised of a wheeled support frame, a horizontal sheet roller supported on the frame for pulling a sheet positioned beneath a patient, a drive means mounted on the frame for turning the roller, and control circuitry for controlling the operation of the motor, and thus the roller. In addition, the device may include an adjustable guide bar to position the sheet at the optimum level.

These elements are assembled in a manner permitting ease of repair and cleaning, and especially, safety to the caregiver and to the patient. Specifically, the device is designed with the drive mechanism and most of the electrical components inside the frame, with access being only by way of removable access plates. The only electrical components outside of the frame are an insulated electrical connector cord to connect the unit to a electric wall outlet, and an operating switch connected to the device with a low voltage connection cable. Therefore, during use, the caregiver and patient are not exposed to mechanical or electrical elements that could cause accidental injury.

When used, the device is rolled into position adjacent the patient's bed with the sheet roller parallel to the longitudinal axis of the bed and at a level above the level of the bed mattress upper surface upon which the patient rests. One end of the sheet is attached to the roller with clips.

The length of the roller will depend upon the overall design of the apparatus, but will normally be approximately equal to the length of the sheet, or one-half of the sheet length, with the clips being positioned at either end of the roller. The invention also contemplates the use of more than one sheet, and the use of multiple pairs of clips on the roller. If the roller height is less than optimal relative to the height of the bed top surface, the sheet can be run from the bed beneath the above-mentioned guide bar before being connected to the roller. The height of the guide bar may be vertically adjusted.

The caregiver then actuates the electric motor, in a manner to be described herein in detail, rotating the roller to pull the attached sheet across the bed surface and upwardly at a desired angle, causing the patient to roll away from the device. The caregiver may assist in guiding the turning of the patient. However, the device alone exerts the needed tuning force, thus minimizing any risk of injury to the caregiver.

The roller is mounted of a moveable support frame for ease of movement to various locations, e.g., from one bed to another. The support frame includes a pair of spaced, parallel roller supports or arms to position the roller at the desired level, and a base upon which the roller support arms are mounted. The base may include a horizontal member joining the lower ends of the roller support arms.

The support frame preferably includes spaced, parallel, horizontal legs that normally extend outwardly from one side of the support frame perpendicular to the roller axis, so that the legs are under the bed when the roller is placed alongside the bed, preventing the device from tipping toward the bed when the sheet is pulled. A plurality of wheels or casters are mounted on the underside of the legs. One or more of these wheels can include releasable locking means to hold the apparatus in a stationary position during use. A part of the base, e.g., the outer ends of the horizontal legs, can be weighted to provide increased stability.

The legs may be mounted in a fixed position perpendicular to the roller axis. Preferably, however, the legs are pivotally attached at their inner ends to the frame base so that the legs can be pivoted to any position between perpendicular to the roller axis and parallel to the roller axis to facilitate movement of the device through narrow spaces, such as the space between the bed and an adjacent wall.

For example, mounting plates may be positioned on the lower surface of the base, with each plate including a downwardly extending shaft that projects into a receiving opening adjacent the inner end of each leg. The leg can then be pivoted around the shaft to move from the perpendicular orientation toward the parallel orientation when movement past an obstacle such as a bed leg is necessary. In order to readily return the device leg to the perpendicular position once the obstacle is passed, a return means, such as a return spring or torsion bar is attached between the shaft or other part of the mounting plate and the device leg. In addition, releasable locking means, such as detents on the leg or plate, and mating projections on the other element, are provided to hold the leg in the desired perpendicular position until another obstacle is encountered.

The roller drive means includes a reversible electric motor, which may be connected through an AC/DC transformer to an alternating current source, or to a storage battery. The motor is mounted on the support frame, and preferably on the support frame base to provide greater stability. In the preferred embodiment, the motor is adjacent the lower end on one of the roller support arms, with the connector extending upwardly through the interior of the support arm to connect the motor to one end of the roller. The connector is preferably a chain or drive belt extending around toothed gears mounted on the motor and roller shafts.

For safety purposes, the motor is enclosed in a housing, which will be considered for purposes of the description as a part of the frame, to prevent contact of the motor by individuals, or items such as a bed sheet. Access plates may be provided in the housing or frame support arms to provide ready access to the connector and the controller. An electrical cord extends outwardly from the housing or other part of the frame to connect the device to an electrical outlet.

As an additional safety feature, the motor is controlled through an electrical circuit that minimizes the likelihood of inadvertent starting of the motor. In addition, the circuitry limits the time of actuation of the motor once the motor is started, further minimizing the risk of injury.

More specifically, the motor is operated through an electrical circuit that comprises a controller that includes a timer that can be used to predetermine the length of time that the motor runs on a single cycle, or the number of roller revolutions. The circuit additionally include an on/off switch, and/or a forward/reverse switch to control the direction of roller rotation, and an operating switch to start and stop the motor connected into the circuit with a flexible, extendable cable, allowing the caregiver to control the rotation of the roller at a distance from the apparatus. For example, the apparatus can be positioned on one side of the bed, while the caregiver operates the apparatus from the opposite side of the bed. The controller and all of the wiring, except for the operating switch and an insulated cord to connect the device to an electrical outlet, is located in the interior of one of the roller support arms or within the motor housing to prevent contact by individuals and items such as bed sheets, and to make the device easier to clean.

Again for safety purposes, the electrical circuit is designed so that the on/off switch must be on before operation. In addition, the operating switch is preferably designed to require two actuating steps or "clicks" within a predetermined time period, e.g., one second, before completing the circuit. A timer is also included in the circuit to limit the time the motor runs to a predetermined time period.

The efficiency of the patient positioning device depends upon the angle at which the sheet extends upward from the side of the patient. This angle, in turn depends upon the relative heights of the roller and the bed surface. While either of these heights are theoretically adjustable, it has been found that the efficiency can by more readily improved by including as part of the device a horizontal sheet guide bar that is vertically adjustable to one or more positions at levels below and parallel to the sheet roller. With this option, the sheet, in addition to being directly connected to the roller, can extend from the patient beneath the guide bar and then upwardly to the sheet roller.

Thus, the angle at which the sheet extends upwardly will be determined by the height of the roller or the adjustable bar relative to the bed surface. The guide bar can be supported at it ends on mounts that are joined to the frame support arms. Preferably, the mounts are pivotal so that the bar can be rotated to a high or low position.

When used to turn a patient, the apparatus is wheeled next to the bed containing the patient, and positioned with the roller and roller support arms adjacent one side of the bed, and the horizontal legs under the bed. The caregiver then clips one end of a sheet that is under the patient onto the roller using the roller clips. The sheet may first be inserted under the guide bar if a different angle is desired.

The on/off switch is turned to on, the direction switch is turned to forward, and the drive means is then actuated by clicking the operating switch twice within approximately one second to initiate the timed cycle, thereby turning the roller, and winding the sheet onto the roller. The sheet, as it is pulled toward the apparatus, and upwardly due to the positioning of the roller or guide bar, imparts a turning movement to the patient. This tuning movement can be supplemented by a slight effort from the caregiver, who guides the patient's movement to the desired position.

The above procedure is also followed when the apparatus is used to move a patient between beds or other patient carriers, such as stretchers. For this purpose, the sheet is extended across both beds and preferably beneath the guide bar to draw the sheet along a substantially horizontal pathway.

Thus, it is an aspect of the invention to provide a patient positioning device for turning or moving a bedridden patient by pulling a sheet positioned under the patient comprising a support frame; a horizontal roller supported by the support frame, the roller including attachment means for attaching the sheet to the roller; drive means mounted on the frame and operatively attached to the roller; elongated, wheeled legs attached beneath the frame; and electrical circuitry controlling the operation of the motor, and thereby the rotation of the roller.

It is another aspect of the invention to provide a patient positioning device for turning or moving a patient on a bed having opposed sides by pulling a sheet positioned under the patient toward one side of the bed comprising a support frame including first and second vertical roller support arms, the support arms having upper ends and lower ends, and a horizontal connecting arm joining the lower ends of the support arms; a horizontal roller supported by the support frame, the roller including sheet attachment means and a central shaft with opposed ends; drive means mounted on the connecting arm and operatively attached to the roller through the interior of one of the support arms; first and second wheeled legs having inner ends pivotally attached beneath the frame; a vertically adjustable sheet guide bar mounted on the frame beneath the roller; and electrical circuitry controlling the operation of the motor, and thereby the rotation of the roller, the circuitry including a timer for stopping operation of the motor after a predetermined time period.

Other aspects of the invention will become apparent to one skilled in the art to which the present invention pertains upon a reading of the detailed description of the invention that follows, taken together with the drawings.

DETAILED DESCRIPTION OF THE INVENTION

Figure 1:
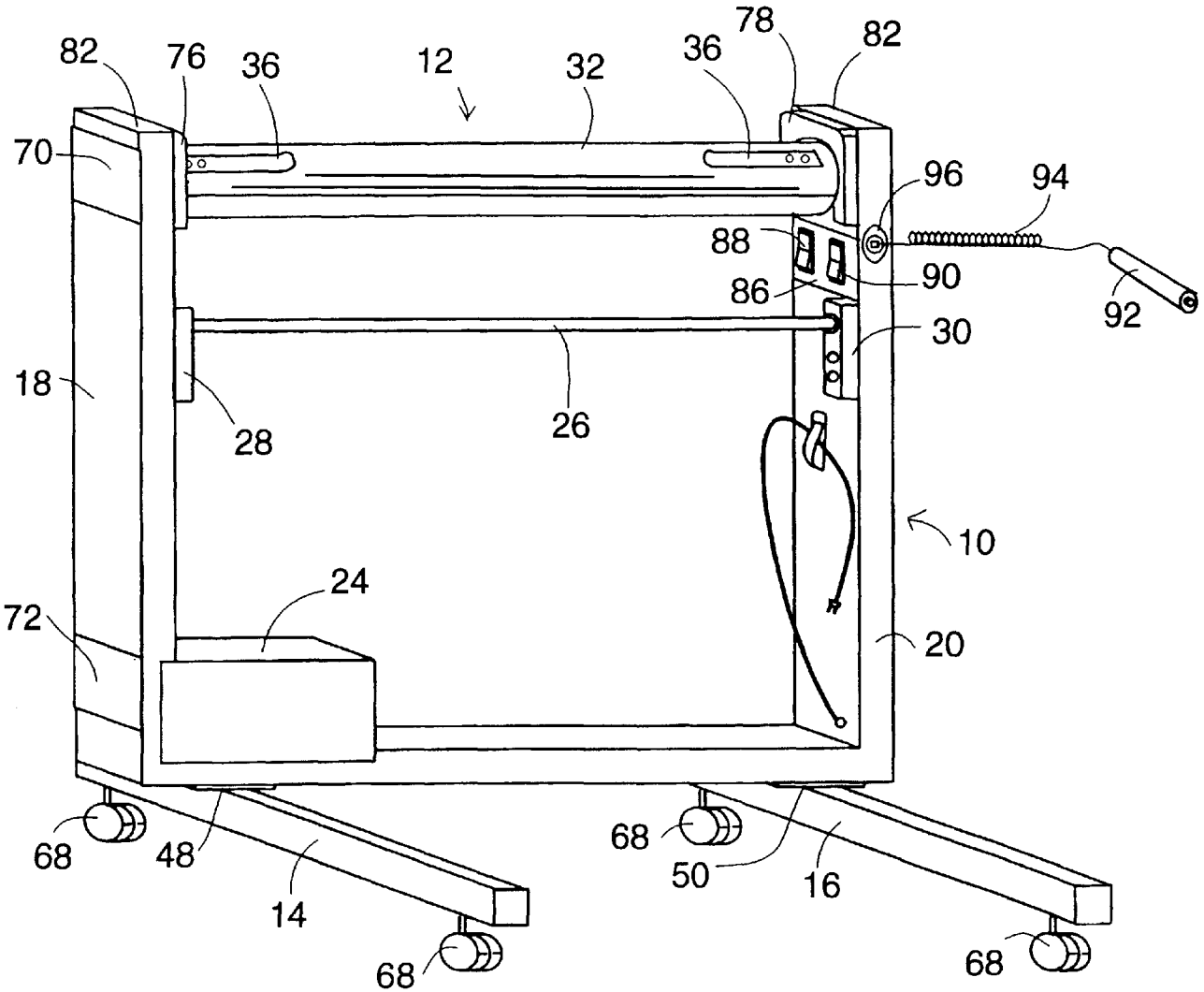
FIG. 1 is a perspective view of the patient positioning apparatus.
Figure 2:
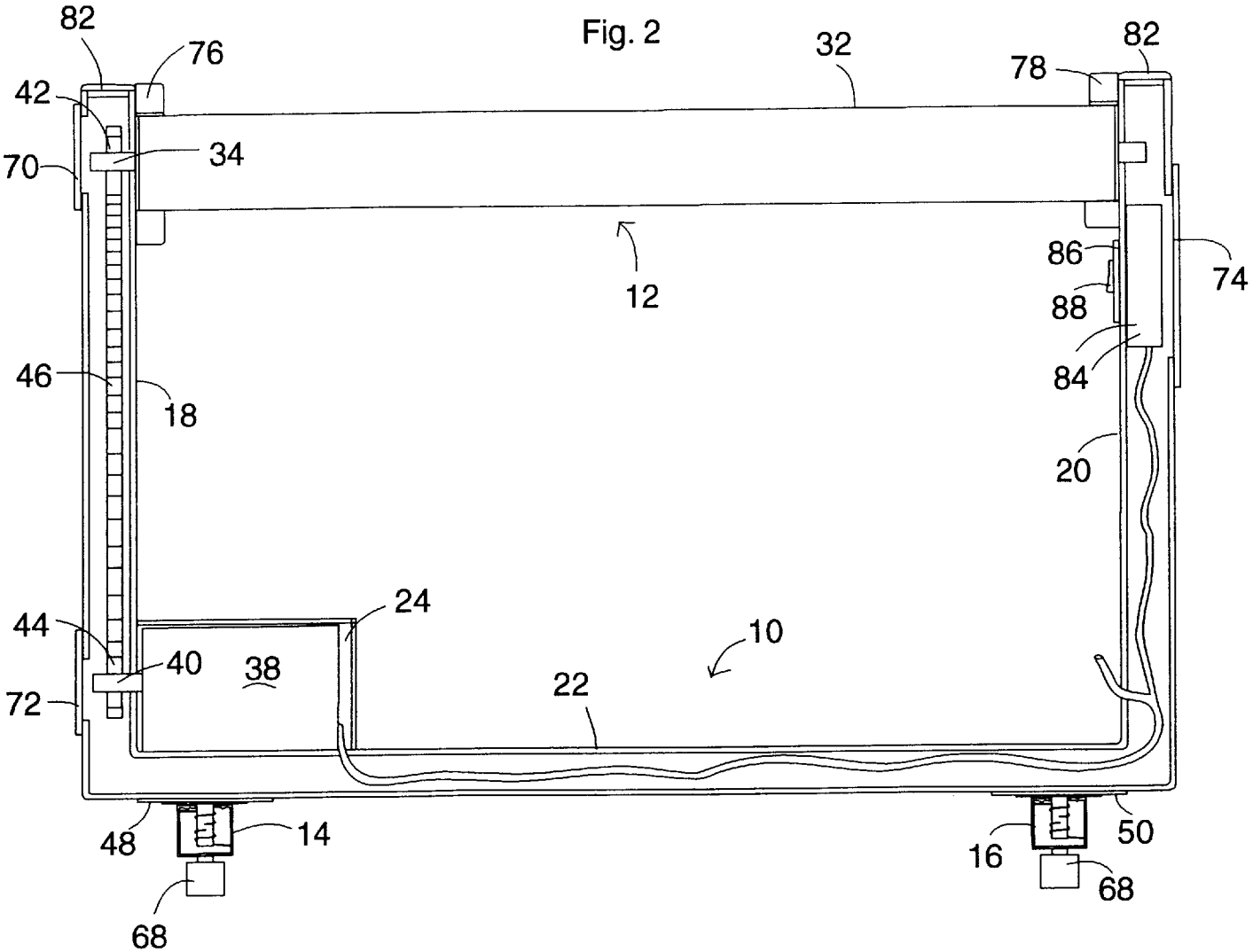
FIG. 2 is a sectional side view of the apparatus of FIG. 1, showing the internal components.

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

The patient positioning device is comprised of a support frame, generally 10, a horizontal sheet roller, generally 12, mounted on frame 10, and wheeled support legs 14 and 16 carrying frame 10 and roller 12.

Support frame 10 includes spaced, parallel, upright, roller support arms 18 and 20, and a horizontal connecting arm 22, joining the lower ends of arms 18 and 20. A motor housing 24 is attached to frame 10 at the junction of support arm 18 and connecting arm 22. A horizontal guide bar 26 extends between support arms 18 and 20 at a level below roller 12, and is attached to arms 18 and 20 with pivotal mounts 28 and 30. Roller 12 includes an annular surface 32 around a central shaft 34. Sheet attachment clips 36 are positioned on the surface of roller 12 for use in attaching an end of a sheet to roller 12.

A electric motor 38 is positioned within motor housing 24, and includes a motor shaft 40 extending into the interior of support arm 18. An end of roller shaft 34 also projects into support arm 18 above motor shaft 40. Shafts 34 and 40 carry gear wheels 42 and 44, respectively, connected by drive chain 46, permitting rotation of roller 12 by motor 38. Additional gearing, not shown, may be included to adjustably control the speed to rotation of roller 12, which will normally be turned at a speed of about 30 rpm.

Figure 3:
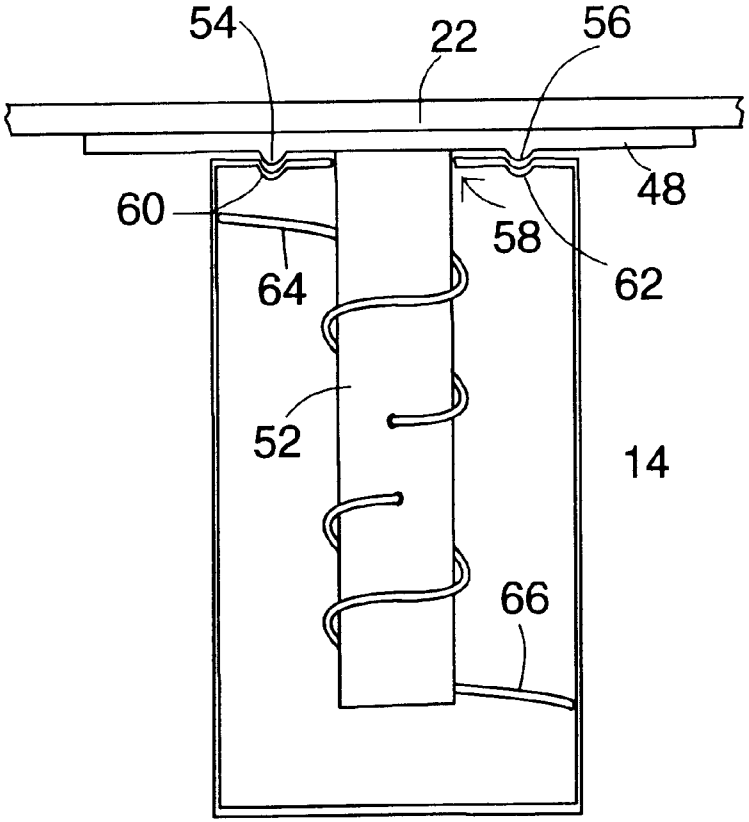
FIG. 3 is a detailed sectional side view of the leg pivot means.

Legs 14 and 16 normally extend outwardly from one side of frame 10, perpendicular to the axis of roller 12, and are pivotally attached at their inner ends to the lower surface of connecting arm 22 with mounting plates 48 and 50, respectively. Details of the attachment of leg 14 is illustrated in FIG. 3. It will be understood that leg 16 is similarly attached and functions in the same manner. As shown in FIG. 3, mounting plate 48, secured to the underside of connecting arm 22 by screws or other conventional means, not shown, includes a downwardly extending mounting shaft 52 and a pair of spaced protrusions 54 and 56.

The upper surface of leg 14 includes an opening 58 to receive shaft 52, and a pair of detents 60 and 62 positioned to engage protrusions 54 and 56, respectively. Torsion springs 64 and 66 extend between shaft 52 and leg 14 to urge leg 14 to a normally perpendicular position relative to roller 12, in which protrusions 54 and 56 will be mated with detents 60 and 62.

When leg 14 engages resistance, such as when the device is being pushed between a wall and the leg of a bed, leg 14 pivots about shaft 52 toward a parallel orientation until the width of the device is the same as the space available. When leg 14 is past the area of constraint, torsion springs 64 and 66 urge leg 14 back toward the perpendicular position, and protrusions 54 and 56 again engage detents 60 and 62. Casters 68 are positioned on the underside of legs 14 and 16, so that the device can be easily rolled to the desired location.

Figure 4:
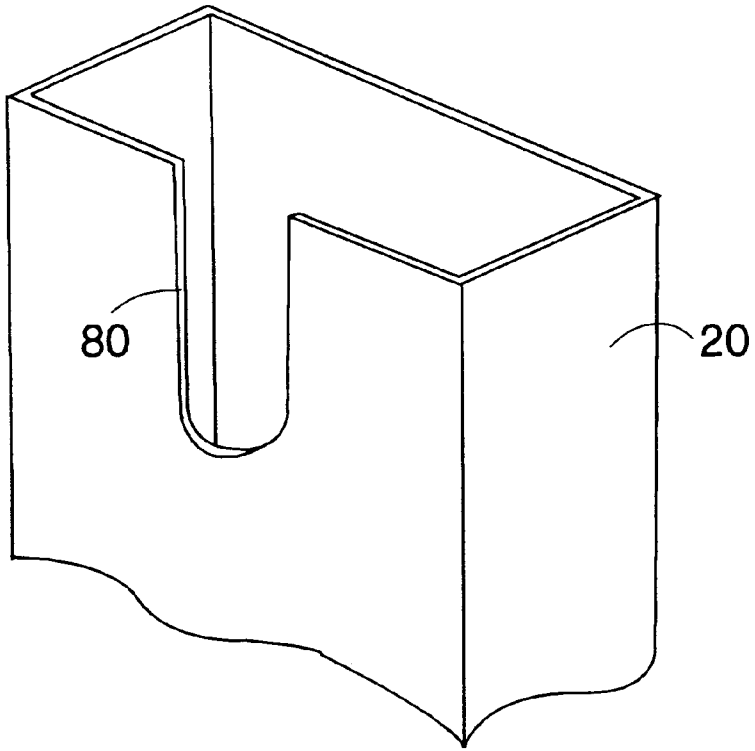
FIG. 4 is a detailed prospective view of the top of a support arm.

In order to improve ease of use and safety of the device, access plates 70 and 72 are removably attached to arm 18 to facilitate access to gears 42 and 44, and drive chain 46. Similarly, access plate 74 is attached to support arm 20 to facilitate access to the interior of arm 20. Protective covers 76 and 78 are positioned over the juncture of roller 12 with support arms 18 and 20, respectively, to prevent items, such as a bed sheet, from being caught on the ends of roller 12. The upper ends of arms 18 and 20, as illustrated in FIG. 4, include roller shaft receiving slots 80 on their inner faces, and covered by protective caps 82. Therefore, in order to attach, remove, or adjust the position of roller 12, it is only necessary to remove the protective caps.

Actuation of motor 38 and its direction of rotation, and thus the movement of roller 12, is controlled via controller 84, mounted in support arm 20. Alternatively, controller 84 may be mounted within housing 24 or another part of frame 10. Controller 84 is connected to switch plate 86, which includes an on/off switch 88, and a forward/reverse switch 90. Controller 84 is also connected to an operating switch 92 via an extendible cable 94, attached to the device at connector 96. Switch 88 opens and closes the connection of the control circuit to a power source, while forward/reverse switch 90 controls the direction of rotation of motor 38 and thus the direction of rotation of roller 12.

In the preferred embodiment, the "forward" direction of the roller moves the upper surface of roller 12 away from the bed. Since the sheet is attached over the top of roller 12, the "forward" direction is the direction for pulling the sheet, and thereby turning the patient. The "reverse" direction is used to unwind the sheet from roller 12.

Operating switch 92 is of the automatic return, or clicker, type and is actuated by pushing and releasing. For the purpose of safety, controller 84 includes a timer circuit that actuates motor 38 for a predetermined time period upon receiving two "clicks" from the operating switch within a short time period, e.g., about one second. Operation of motor 38 can be stopped during the time period by one click, and resumed with a single click for up to the remainder of the time period. Thus, actuation of the device by inadvertent clicking of the switch is prevented. Also, the device is automatically stopped after the predetermined time.

In operation, the device is positioned with the legs 14 and 16 pushed beneath the bed, and with roller support arms 18 and 20 against one side of the bed, positioning roller 12 adjacent and parallel to one side of the bed, and above the plane of the bed surface. During positioning, legs 14 and 16 may pivot as described above, but return to their perpendicular position for use of the device.

One side of a sheet or other flexible material beneath the patient is optionally passed beneath guide bar 26, and then clipped with clips 36 to roller 12. Switch 88 is moved to the "on" position, and switch 90 to the "forward" position. Switch 92 is then clicked twice to begin an operating cycle, causing the sheet to wind onto roller 12. Further rotation of roller 12 pulls the sheet toward the device and upwardly, exerting a turning movement to a patient supported on the sheet, and tuning the patient without significant exertion by the caregiver. After turning the patient, tension on the sheet can be released by moving switch 90 to "reverse" and clicking operating switch 92 twice.

To move a patient from one bed to another, the device is positioned in the above manner against the side to the bed onto which the patient is to be moved, with the sheet extending across both beds and under the patient. As above, the sheet extends under guide bar 26 and is substantially parallel to the bed surfaces. The device is then operated as above to pull the patient from one bed to the other.

Certain modifications and improvements will occur to those skilled in the art upon a reading of the foregoing description. It should be understood that all such modifications and improvements are within the scope of the invention.

What is claimed is:

1. A device for positioning a patient on a bed having opposed sides by pulling a sheet positioned under the patient toward one side of the bed comprising:

a) a support frame including a base and a pair of spaced support arms extending upwardly from said base;

b) a horizontal roller supported by said support frame, said roller including a central shaft, an outer surface, and attachment clips on said outer surface;

c) an electric motor mounted on said frame and operatively attached to said central shaft;

d) first and second wheeled legs, each leg having opposed ends, said legs being pivotally attached adjacent one of said ends to said frame base, and including releasable locking means for releasibly holding said legs perpendicular to the axis of said roller, and return means for urging said legs toward positions perpendicular to said roller, said legs being pivotal in either direction toward an orientation parallel to said roller; and e) electrical circuitry controlling the operation of said motor, and thereby the rotation of said roller.

2. The device of claim 1, further including a sheet guide bar parallel to and beneath said roller, said guide bar extending from one support arm to the other support arm.

3. The device of claim 1, wherein said electric motor includes a motor shaft operatively connected to said central shaft through one of said support arms.

4. The device of claim 1, wherein said electrical circuitry includes an on/off switch, a position switch to control the direction of rotation of said roller, an operating switch to actuate said motor, and a connecting cable attaching said operating switch to said electrical circuitry, said operating switch being capable of actuating said motor only when said on/off switch is in the on position.

5. The device of claim 1, further including a timer.

6. The device of claim 1, wherein all of said electric circuitry, except for said operating switch and connecting cable is enclosed.

7. A device for positioning a patient on a bed having opposed sides by pulling a sheet positioned under the patient toward one side of the bed comprising:

a) a support frame including first and second vertical roller support arms, said support arms having upper ends and lower ends, and a horizontal connecting arm joining the lower ends of said support arms;

b) a horizontal roller supported by said support frame, said roller including sheet attachment means and a central shaft with opposed ends;

c) an electric motor mounted on said connecting arm and operatively attached to said roller through the interior of one of said support arms;

d) first and second wheeled legs having inner ends pivotally attached beneath said frame, and including releasable locking means for releasibly holding said legs perpendicular to the axis of said roller, and return means for urging said legs toward positions perpendicular to said roller said legs being pivotal in either direction toward an orientation parallel to said roller; and e) electrical circuitry controlling the operation of said motor, and thereby the rotation of said roller, said circuitry including a timer for stopping operation of said motor after a predetermined time period.

8. The device of claim 7, further including a horizontal, vertically adjustable sheet guide bar extending from one support arm to the other support arm beneath said roller.

9. The device of claim 7, wherein the upper ends of said support arms are slotted to receive the ends of said roller shaft.

10. The device of claim 7, wherein said support arm include inner faces, said device further including shields adjacent said inner faces covering the intersections of said roller and said support arms.

11. The device of claim 7 wherein said electrical circuitry includes a controller, and wiring joining said controller to said motor, said wiring extending through the interior of said frame.

* * * * *